US005206955A

United States Patent [19]

Milligan

[11] Patent Number: 5,206,955

[45] Date of Patent: May 4, 1993

[54] PROTECTIVE FACE GUARD

[76] Inventor: Norman O. Milligan, P.O. Box 70400, Richmond, Va. 23255

[21] Appl. No.: 893,787

[22] Filed: Jun. 5, 1992

[51] Int. Cl.[5] ..... A41D 13/00

[52] U.S. Cl. ..... 2/9; 2/424; 2/425

[58] Field of Search ..... 2/424, 425, 9, 11, 15, 2/10, 206, 173

[56] References Cited

U.S. PATENT DOCUMENTS

| | | | |
|---|---|---|---|
| 1,060,220 | 4/1913 | White | 2/9 |
| 1,449,183 | 3/1923 | Johnstone | 2/9 |
| 1,488,812 | 4/1924 | Goodman | 2/9 |
| 2,616,081 | 11/1952 | Weaver et al. | 2/9 |
| 2,627,602 | 2/1953 | Goldsmith | 2/9 |
| 3,041,623 | 7/1962 | Glahe | 2/9 |
| 3,082,765 | 3/1963 | Helmer | 2/424 |
| 3,373,443 | 3/1968 | Marietta | 2/424 |
| 3,448,738 | 6/1969 | Berghash | 2/9 |
| 3,608,089 | 9/1971 | Abbatelli | 2/9 |

*Primary Examiner*—Clifford D. Crowder
*Assistant Examiner*—Michael A. Neas
*Attorney, Agent, or Firm*—Olive & Olive

[57] ABSTRACT

A protective face guard for use in baseball and other sports is disclosed and which includes a plastic molded mask piece, an impact cushioning forehead pad, an impact cushioning mouth pad, a strap and a mouth guard. The mask piece includes a front protective portion extending from a point just above the player's head to a point below the player's chin and also includes two side protective portions extending from opposite sides of the front portion. The mask piece is formed with both a visor aperture to accommodate the visor of a cap worn by a player and a vision aperture which provides the player with an unobstructed front and peripheral view.

8 Claims, 2 Drawing Sheets

PROTECTIVE FACE GUARD

BACKGROUND OF THE INVENTION

1. Field of the Invention

The invention relates to a protective face guard for use by athletes. The invention relates especially to a protective face guard for baseball players, particularly although not exclusively, for young baseball players.

2. Description of the Related Art

The need for certain athletes to wear protective gear to protect the head and face has long been recognized. In the sport of football, for example, players wear helmets having face guards to protect the head and facial areas. The later described face guard of the invention is adaptable to many sports, (e.g., soft ball, racquetball, lacrosse, paint ball, field hockey); however, the discussion of the related art will focus primarily on practices which relate to use of the invention face guard in connection with baseball. It is to be understood however that the later described face guard of the invention is not limited to that sport.

Baseball players holding certain field positions typically wear protective head gear. While at bat, a batter wears a batter's helmet to protect his head from being struck with a pitched baseball. Additionally, the catcher wears a catcher's mask which is specially designed for the ball activity a catcher is likely to encounter at home plate. Other defensive baseball players, such as basemen, short stops, and outfielders, typically do not wear protective gear. However, the need to protect the facial areas of other defensive players is equally important.

The purpose of a protective face guard is to reduce injury to a player. A baseball player, in particular a young player who is just learning the game, is subject to a number of injuries which could be diminished or avoided by a protective face guard. Players often risk being struck by hit or deflected balls for example by line drives which come directly and quickly off a batter's bat, by ground balls which can bounce off the ground and hit a player's chin or face, or by collision with another player. In addition, to the obvious benefit of reducing injuries, athletes who wear protective gear feel more at ease about performing to the limit of their athletic ability without fear of injury and as a result develop confidence in their playing ability, and become more skilled in the game pursued.

A protective face guard is not effective or successful if the player, intended to be protected by the face guard, will not wear it. Protective face guards have previously been developed, for example, as illustrated in U.S. Pat. 3,132,345 of Keith. However, no face guard has proven completely successful for use by baseball players, particularly young players playing in defensive positions. A face guard which requires special cap attachments (for example, of the type shown in the referred to Keith patent) is cumbersome to put on and remove, and thus is not a viable option.

An effective and successful protective face guard must meet several goals. An effective face guard must be easy to put on, take off, and wear. The face guard must not obstruct a player's ability to see and watch a ball, other players or the field. The face guard must also conform to league uniform regulations, which typically require the wearing of a league baseball cap. The face guard should not, therefore, prevent the player from wearing a baseball cap. A cap protects a player's head from the sun, and provides a sun visor. A face guard which requires that the baseball cap be removed or turned backwards on the player's head hinders the cap's ability to protect the player. If a protective face guard does not meet these recited goals, a player will not wear the face guard, and thus will not be protected during play. It should also be noted that the face guard of the invention is presently designed for players in defensive positions and is not meant to replace the head gear specially designed for offensive players, catchers and base coaches.

One advantage of the protective sports face guard of the invention is that it is easy and convenient to use.

Another advantage of the face guard of the invention is its adaptability to the protection of young baseball players, particularly those players playing defensive positions.

Other advantages will be more fully apparent from the following disclosure and appended claims.

SUMMARY OF THE INVENTION

The protective face guard of the invention is comprised of a one-piece lightweight molded mask piece, a forehead pad and a mouth pad both of which are secured to the inside surface of the mask piece, a strap and a mouth guard. The mask piece is formed from a relatively thin plastic material having high impact strength and while illustrated as transparent, may be tinted. The uppermost edge of the mask piece resides slightly above the player's head. The lowermost edge of the mask piece resides below the player's chin to cover the player's throat area. The mask piece extends from the temple area of one side of the player's face to the temple area of the opposite side of the player's face.

A particular feature of the protective face guard of the invention is that the mask piece is formed with a visor aperture sized and positioned to accommodate the insertion of the bill of a regulation baseball cap. The mask piece of the face guard is also formed with a vision aperture such that, when the face guard is worn, the vision aperture is positioned opposite the player's eye area. The vision aperture is somewhat oval shaped to provide the player with an unobstructed forward and substantially unobstructed peripheral view. The lower portion of the vision aperture extends below the player's sight line to a level slightly above the tip of the player's nose so as to provide protection to the player's nose. However, the vision aperture is sized so that a baseball cannot pass through the opening, even at the opening's widest point.

The face guard in the illustrated embodiment is secured to the player's head by a strap which generally surrounds the player's head approximately above the ears. The face guard is equipped with a forehead pad and a mouth pad which effectively position the face guard relative to the player's face. The thickness of the pads permits the player to wear glasses when wearing the protective face guard of the invention, and without experiencing any loss of forward or peripheral vision. The forehead and mouth pads also protect and cushion the player from the impact of blows to the face guard by hit or deflected balls by distributing the impact of the blows to the pads and the mask piece.

DETAILED DESCRIPTION OF THE INVENTION

Figure 1:
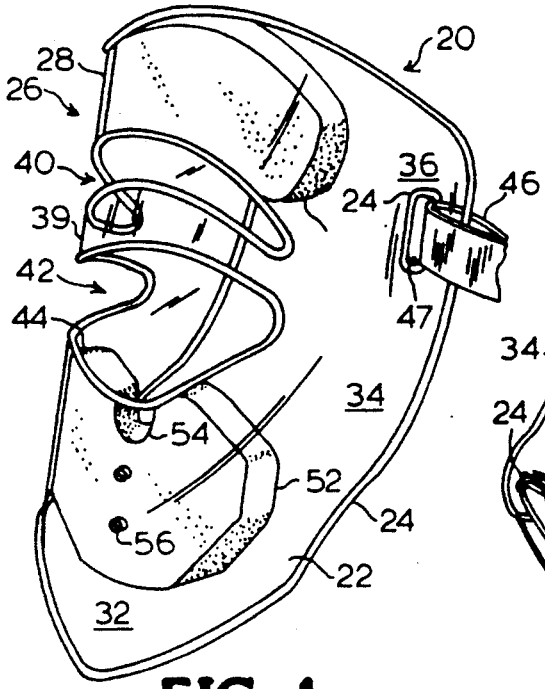
FIG. 1 is a front perspective view of the protective face guard of the invention without a mouth guard.

Referring now to the Figures, the protective face guard 20 of the invention is generally comprised of a mask piece 22, a strap 46, a forehead pad 50, a mouth pad 52, and a mouth guard 64.

Mask piece 22 is preferably formed from a tough, rigid, non-shattering molded, plastic material which can withstand and deflect direct hits by a baseball or the like. Mask piece 22 may be formed by the injection mold process and incorporates an integrally formed beading 24 along the outer edges and aperture edges of mask piece 22 and which serves to reinforce and give rigidity to both the outer edges, slot edges and aperture edges of mask piece 22 and also serves to prevent breaking and cracking. Beading 24 also serves to reduce wear to strap 46 by the edges of slots 47. Beading 24 is preferably formed so as to be approximately twice the average thickness of mask piece 22.

A polycarbonate material, such as the polycarbonate material known in the trade and sold under the name LEXAN TM, is particularly suitable for making the mask piece 22 because of its high impact strength and its capability for being tinted and for providing a non-reflective exterior surface when molded. A non-reflective exterior surface on mask piece 22 reduces sun and artificial light reflected off the mask piece 22, and reduces harmful sun rays from penetrating the mask piece 22. A tinted mask piece 22 gives the protective face guard 20 an aesthetically pleasing appearance. However, for purposes of illustrating the invention, mask piece 22 is assumed to be made of a transparent, non-reflective and uncoated material.

Figure 2:
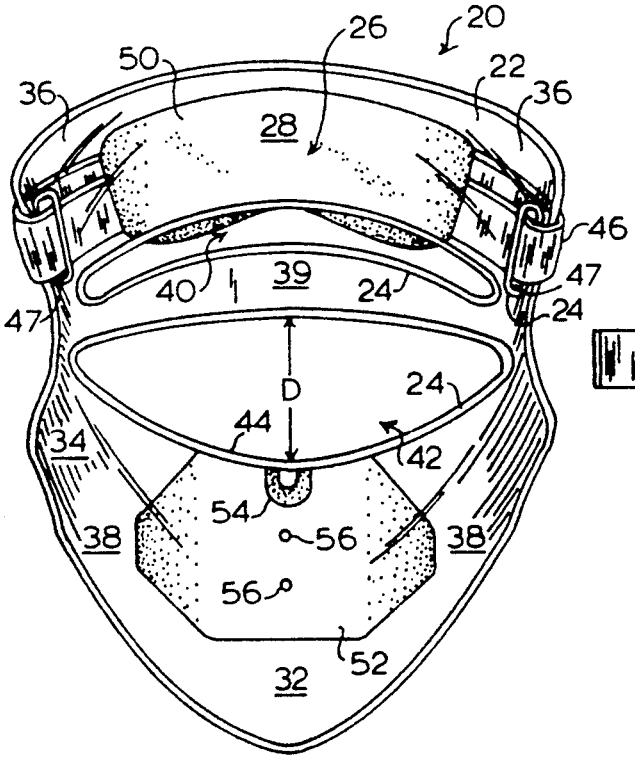
FIG. 2 is a front view of the protective face guard of FIG. 1.
Figure 3:
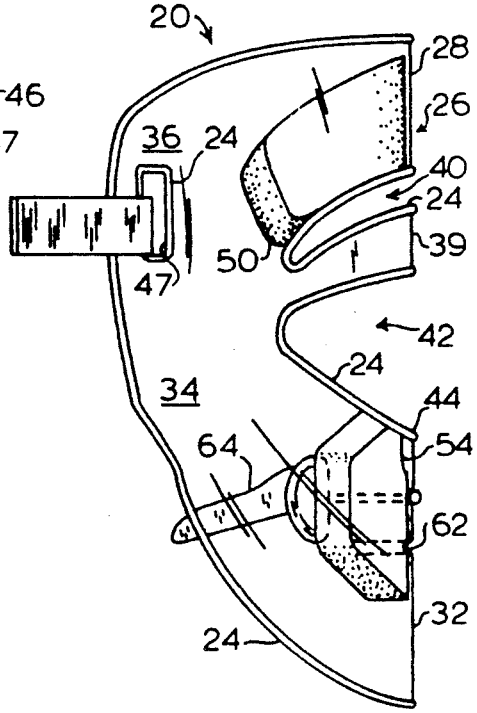
FIG. 3 is a side view of the protective face guard of the invention with the mouth guard inserted.
Figure 7:
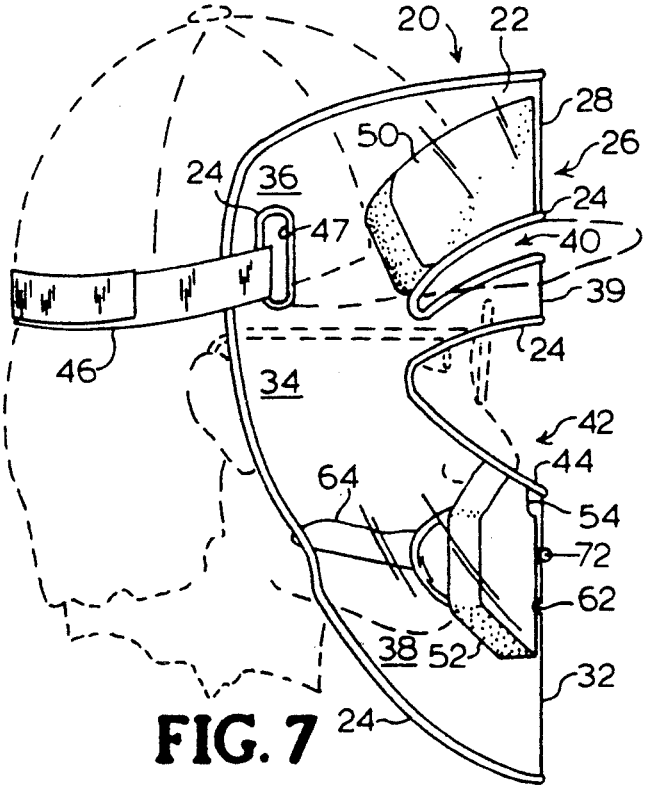
FIG. 7 is a side view of a player donned with the protective face guard of the invention and illustrated as wearing a mouth guard.

Mask piece 22 has a generally outward curvature protective of the player face, which curvature also assists in deflecting balls. Mask piece 22 includes a front portion generally designated 26 and integrally connected side portions generally designated 34, shown from a front view in FIG. 2 and from a top view in FIG. 4. Side portions 34 include upper regions 36 as indicated in FIGS. 2 and 7, which are designed to protect the player's temple areas. Side portions 34 also include lower regions 38 indicated in FIGS. 2 and 7 which are designed to protect the player's cheek and jaw areas.

Side portions 34 also include slots 47 for receiving a strap 46. Slots 47 are oppositely disposed on the upper regions 36 of side portions 34 as seen, for example, in FIGS. 2, 4 and 5 and are bounded by the previously described beading 24. Strap 46 is fitted with a suitable closing means 48 which may be constructed in any conventional manner but preferably in a manner which permits strap 46 to be adjustable. Strap 46 is illustrated as being formed as a single piece having two ends referred to as the first and second ends. A first end is inserted into a first slot 47 from the outside of mask piece 22 and is pulled through the first slot 47 to and through the opposite slot 47. The first end of strap 46 adjustably attaches to the second end of strap 46 to close strap 46 around the player's head. Strap 46 may also comprise two pieces (not shown) having one strap piece attached to one slot 47, and a second strap piece attached to the opposite slot 47, whereby the free end of the first piece attaches to the free end of the second piece to close strap 46. It is preferable that the closing means 48 for strap 46 permit the strap 46 to be opened, closed and adjusted in an easy and convenient manner, for example, through hook and loop means (e.g., a suitable hook and loop means such as that known in the trade and sold under the name VELCRO TM. Other means for releasably securing the face guard 20 to the player's head may be employed.

Front portion 26 of mask piece 22 includes an upper region generally designated 28 and a lower region generally designated 32. Upper region 28 is designed to protect the player's forehead area as best seen in FIG. 7. Upper region 28 includes a visor aperture 40, as seen in FIGS. 1, 2, 3, 5, 6 and 7. Visor aperture 40 has an elongated oval shape and is bounded by the previously referred to beading 24. A significant feature of the invention resides in visor aperture 40 being sized to accommodate the bill or visor of a cap, particularly of a standard, regulation baseball cap, and extends approximately the full width of front portion 26. As best seen in FIG. 7, when face guard 20 is worn, the player's cap visor is inserted from the inside of mask piece 22 through visor aperture 40. In this manner, the player can wear a cap in its intended manner while wearing the protective face guard 20. The cap visor when inserted into visor aperture 40 also has the effect of substantially stabilizing the protective face guard 20 on the player.

Upper region 28 of front portion 26 of mask piece 22 is also formed with a band portion 39 located below visor aperture 40 and above vision aperture 42. Band portion 39 extends between integrally formed side portions 34 and gives front portion 26 structural strength. Side portions 34 provide unbroken exterior side surfaces and form continuations of the generally outward curvature of the front portion 26 and assist in deflecting any ball hitting mask piece 22. Band portion 39 is preferably formed with additional thickness (not shown) as compared to the other portions of mask piece 22 so as to give band portion 39 additional structural integrity.

Vision aperture 42, shown in FIGS. 1, 2, 3, 5, 6 and 7, is provided in mask piece 22 to form an opening located in front of the eye area of the player when the protective face guard 20 is worn. Vision aperture 42 is a generally oval shaped opening and is bounded by the previously described beading 24. Vision aperture 42 extends the full width of front portion 26 and has a lower edge 44 which dips to a point slightly above the tip of the player's nose to provide protection to the player's nose. Vision aperture 42 gives the player both unobstructed forward and peripheral vision. The player can thus see both to his right and to his left without turning his head from side to side. A player playing short stop, for example, and wearing the protective face guard 20, can see the baseline without turning his head from side to side while also watching the batter. Distance D, shown in FIG. 2, of vision aperture 42 gives the player the described unobstructed view and is narrow enough so that the ball is prevented from entering the vision aperture 42. So long as the player's view is not obstructed, distance D may be varied slightly according to the size of the ball or other play piece being utilized in the game. A racquetball, for example, may require a slightly narrow vision aperture 42.

Front portion 26 also includes lower region 32 designed to protect the player's nose, chin and throat areas. Integrally formed lower region 32 of the mask piece 22 extends between the side portions 34 and terminates in a rounded bottom. As best seen in FIG. 7, lower region 32 extends below the player's chin to cover the throat area and its outermost edge curves to follow the shape of the player's jaw line.

Mask piece 22 includes the previously mentioned forehead pad 50 which is formed from a material which both provides cushioning and resilience. A vinyl/nitrile blend of foam-like material has been found to be a suitable material for forehead pad 50 such as, for example, the type of material sold under the name RUBATEX by Rubatex Corporation of Bedford, VA. Forehead pad 50 is secured to the inside surface area of upper region 28 of front portion 26, and covers substantially the entire inside surface area of the upper region 28, as seen in FIGS. 2, 4 and 5.

In use, the forehead pad 50 absorbs and cushions the force of an impact and distributes the force throughout pad 50 and mask piece 22 such that the player is protected from the blow. Forehead pad 50 may be adhered or otherwise secured to the inside surface by an conventional means which effectively and safely secures pad 50 to mask piece 22 and such that it will not be dislodged in use. An adhesive, or an adhesive tape, applied between the pad 50 and the inside surface of upper region 28 has been found to be a suitable means for securing pad 50 to mask piece 22.

Figure 4:
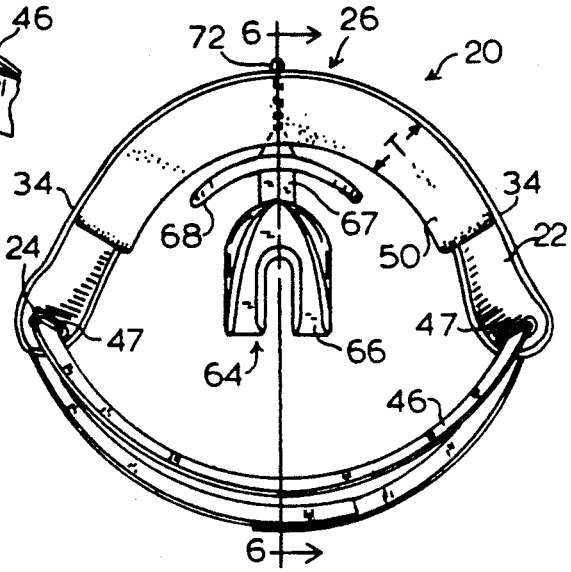
FIG. 4 is a top view of the protective face guard of FIG. 1 and showing the mouth guard inserted into the face guard.
Figure 5:
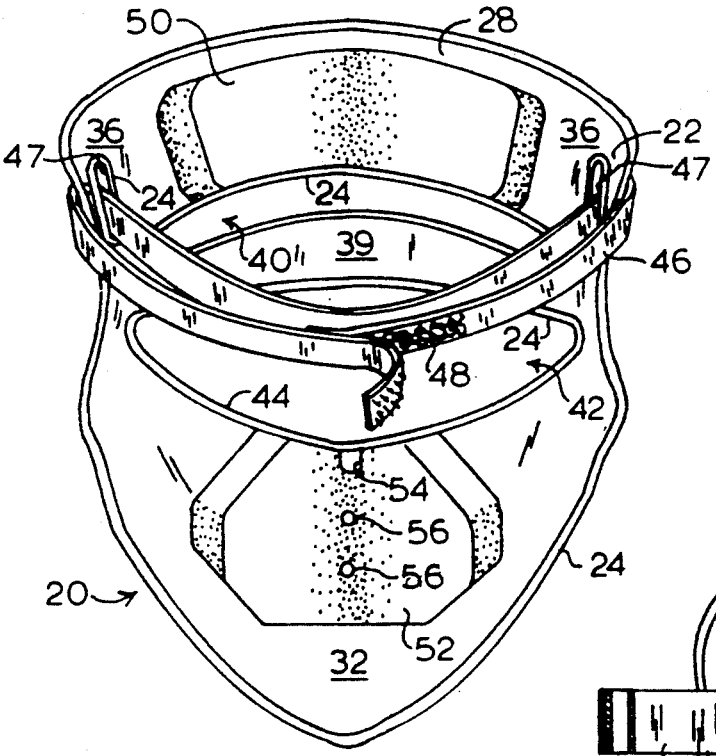
FIG. 5 is a rear view of the protective face guard of FIG. 1.

The thickness T of forehead pad 50, as shown in FIG. 4, determines the distance between the player's face and the inside surface of mask piece 22. Accordingly, thickness T is made sufficient enough so that no portion of the player's face protrudes from mask piece 22 through either visor aperture 40 or vision aperture 42. Additionally, the thickness T is made sufficient enough to position the inner surface of mask piece 22 away from the player's face so that while wearing the protective face guard 20, a player can also comfortably wear eyeglasses without interference with the face guard 20 and without the glasses contacting the mask piece 22, as illustrated in FIG. 7.

Figure 6:
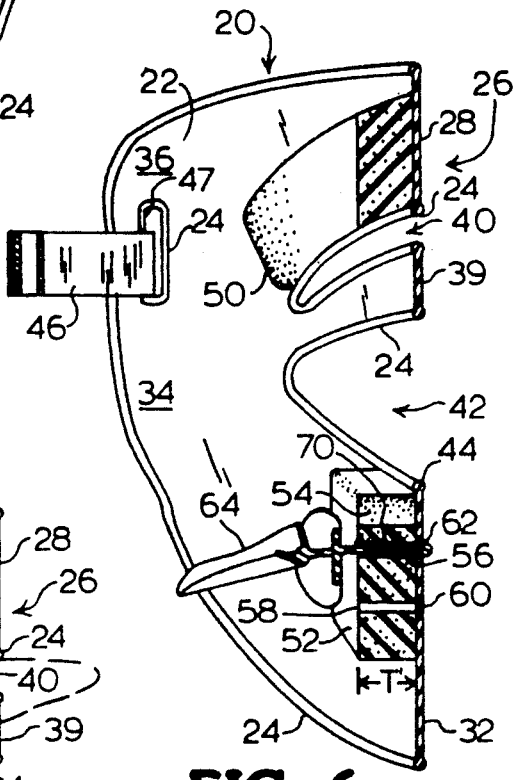
FIG. 6 is a cross-sectional view taken along line 6—6 of FIG. 4.

Also included on front portion 26 is the previously referred to mouth pad 52. Mouth pad 52 is secured to the inside surface of lower region 32 of front portion 26 and is centered below vision aperture 42. The manner in which mouth pad 52 is secured to mask 22, and the material from which the pad 52 is constructed, are similar to those applying to forehead pad 50 as previously discussed. Mouth pad 52 is substantially oval in shape and covers a relatively large surface area of the inside surface of lower region 32. When face guard 20 is worn, the mouth pad 52 should substantially cover the player's mouth, and particularly his teeth. The area covered by pad 52 is also made sufficient enough so that an impact to the player's mouth area will be substantially distributed away from the player and into pad 52 and mask piece 22. The thickness T' of mouth pad 52, as shown in FIG. 6, should also be sufficient enough so that no portion of the player's face protrudes from mask piece 22 and particularly so that no portion of the player's nose protrudes through vision aperture 42. Additionally, thickness T' (FIG. 6) of mouth pad 52 is sufficient to position the inner surface of mask piece 22 away from the player's face so that the player can wear eyeglasses comfortably while wearing face guard 20 as best illustrated in FIG. 7.

Indentation 54 is formed in and is centered on the upper portion of mouth pad 52, as best shown in FIGS. 1, 2 and 5. Indentation 54 permits air passage underneath a player's nose when protective face guard 20 is worn. Mouth pad 52 also includes channels 56 which extend through mouth pad 52, as shown in FIG. 6, from entrance ends 58 to exit ends 60. Entrance ends 58 are positioned vertically along the center of the inside surface of mouth pad 52, as shown in FIGS. 2 and 5. Exit ends 60 abut mask piece 22 at mating mask piece openings 62 which are formed in mask piece 22.

Channels 56 of mouth pad 52 are adapted to accept the stem portion 70 of a modified mouth guard 64. Mouth guard 64 is made from any conventional material known in the art to be suitable for mouth guards, for example, a rubber-like material. The illustrated mouth guard 64 of the invention represents a modified version of the type mouth guard presently made by Primms, Inc. of Tonawanda, NY. When worn by a player, as shown in FIG. 7, mouth guard 64 shields the player's mouth and teeth. Mouth guard 64 additionally stabilizes face guard 20 on the player by limiting side to side movement of mask piece 22 on the player's face. Mouth guard 64 as best seen in FIG. 4, is an integrally formed structure which has at one end teeth guard 66 connected by extension 67 to plate 68. Teeth guard 66 is inserted into the mouth of the player and is placed between the player's top and bottom teeth. Plate 68, when worn, rests against the outside of the player's mouth against the lip area and cushions the player's mouth and teeth areas upon the occurrence of impact or collision with face guard 20. Stem 70 (FIG. 6) extends from plate 68 and tapers at its distal end to terminate with a knob 72 (FIG. 7). Stem 70 of the invention represents a shortened version of the stem found in a conventional mouth guard.

Knob 72 and stem 70 are inserted into one entrance end 58 and through a corresponding channel 56. Knob 72 exits mouth pad 52 at exit end 60 and is inserted through mask piece opening 62, as shown in FIGS. 6 and 7. When mouth guard 64 is fully inserted into mouth pad 52, stem 70 resides within one channel 56. Knob 72 has a diameter larger than the diameter of channel 56 and mask piece opening 62 so that knob 72, once suitably placed, will secure mouth guard 64 in mouth pad 52 and to mask piece 22. Mouth pad 52, stem 70 and knob 72 are constructed from a material which is somewhat malleable so that knob 72 can be inserted through channel 56 and mask opening 62 which both have smaller diameters than the diameter of knob 72. Stem 70 is placed into the respective upper or lower channel 56 which best positions mouth guard 52 for the player at either a relatively high or low level in mouth pad 50.

A principle advantage of the face guard of the invention is that it can be worn with games typically requiring use of a cap. However, it is to be recognized that the face guard can be readily used with games not requiring use of cap and in such event, the visor aperture 40 could be used for additional ventilation or face guard 20 could be made without the visor aperture 40.

While the invention has been described with reference to specific embodiments thereof, it will e appreciated that numerous variations, modifications, and embodiments are possible, and accordingly, all such variations, modifications, and embodiments are to be regarded as being within the spirit and scope of the invention.

What is claimed is:

1. A protective face guard for a game using a ball or the like struck play piece and to be worn on the head of a participating player who also wears a cap having a visor, comprising:

(a) an integrally molded mask piece formed from a lightweight sheet of molded thermoplastic material having:

(i) a front portion of generally outward curvature protective of the player's forehand, eyes, nose, mouth, chin and throat area including:

(aa) a visor aperture positioned in an upper region of the front portion such that when the protective face guard is worn, the visor aperture resides substantially opposite the player's forehead, said visor aperture extending across substantially the full width of the front portion and being of sufficient size to accept the insertion of a visor of a cap worn by the player; and (bb) a vision aperture positioned below the visor aperture and extending across substantially the full width of the front portion and being of sufficient size to provide the player with substantially unobstructed forward and peripheral vision; and (ii) side portions formed to provide unbroken exterior side surfaces forming continuations of the generally outward curvature of said front portion and located at respective opposite sides of and molded integral with the front portion and protective of the player's temple, cheek and lower jaw areas;

(b) a forehead pad secured to the inside surface of said front portion of the mask piece and positioned above said visor aperture, said forehead pad being of sufficient size to cushion a substantial portion of the player's forehead from impacts and being of sufficient thickness to prevent any portion of the player's face from protruding from the mask piece through said visor or vision apertures and such that the mask piece is spaced a sufficient distance outwardly from the player's face to avoid interference with a player's eyeglasses when worn;

(c) a mouth pad secured to the inside surface of said front portion of the mask piece and positioned below said vision aperture, said mouth pad being of sufficient size to cushion a substantial portion of the player's mouth and teeth area from impacts and being of sufficient thickness to prevent any portion of the player's face from protruding from the mask piece through said visor or vision aperture and such that the mask piece is spaced a sufficient distance outwardly from the player's face to avoid interference with a player's eyeglasses when worn;

(d) means operatively associated with said mask piece for releasably securing said mask piece to the head of the player wearing said face guard;

(e) a mouth guard insertable into the mouth of the player wearing the face guard between the player's top and bottom teeth, releasably secured to said mouth pad and extending inwardly therefrom and operative to stabilize said mask piece when in sue; and (f) said mouth guard and mouth pad being formed with respective operatively associated cooperating means enabling the level of said mouth guard to be adjusted relative to said mouth pad.

2. A protective face guard as claimed in claim 1 wherein a lower edge of said vision aperture is located so as to normally assume a position slightly above the tip of the nose of the player wearing the face guard.

3. A protective face guard as claimed in claim 1 wherein each said side portion includes a slot adapted to accept a strap for securing the mask piece of the player's head and said means operatively associated with said mask piece for releasably securing said mask piece to the head of the player wearing said face guard comprises releasably securable strap means operatively associated with said slots.

4. A protective face guard as claimed in claim 1 wherein to establish said cooperating means said mouth guard includes a supporting stem portion, said mouth pad includes upper and lower passages each being adapted to releasably receive said mouth guard stem portion thereby enabling the levee of said mouth guard relative to said mouth pad to be adjusted.

5. A protective brace guard for a game using a ball or the like struck play piece and to be worn on the head of a participating player who also wears a cap having a visor, comprising:

(a) an integrally molded mask piece formed from a lightweight sheet of molded thermoplastic material having:

(i) a front portion of generally outward curvature protective of the player's forehead, eyes, nose, mouth, chin and throat area including:

(aa) an unobstructed visor aperture positioned in an upper region of the front portion such that when the protective face guard is worn, the visor aperture resides substantially opposite the player's forehead, said visor aperture extending across substantially the full width of the front portion and being of sufficient size to conform to the shape of and to accept the insertion of a visor of a cap worn by the player; and (bb) a vision aperture positioned below the visor aperture and extending across substantially the full width of the front portion and being of sufficient size to provide the player with substantially unobstructed forward and peripheral vision; and (ii) side portions formed to provide unbroken exterior side surfaces forming continuations of the generally outward curvature of said front portion and located at respective opposite sides of and molded integral with the front portion and protective of the player's temple, cheek and lower jaw areas;

(b) pad means secured to the inside surface of said front portion of the mask piece operative to cushion the player's face from impacts;

(c) means operatively associated with said mask piece for releasably securing said mask piece to the head of the player wearing said face guard; and (d) a mouth guard insertable into the mouth of the player wearing the face guard, releasably secured to said mouth pad and operative to stabilize said mask piece when in use, said mouth guard and mouth pad being formed with respective operatively associated cooperating means enabling the level of said mouth guard to be adjusted relative to said mouth pad.

6. A protective face guard as claimed in claim 5 wherein said pad means comprises:

(a) a forehead pad portion secured to the inside surface of said front portion of the mask piece and positioned above said visor aperture, said forehead pad portion being of sufficient size to cushion a substantial portion of the player's forehead to cushion the player's forehead from impacts and being of sufficient thickness to prevent any portion of the player's face from protruding from the mask piece through said visor or vision apertures and such the the mask piece is spaced a sufficient distance outwardly from the player's face to avoid interference with a player's eyeglasses when worn,; and (b) a mouth pad portion secured to the inside surface of said front portion of the mask piece and positioned below said vision aperture, said mouth pad portion being of sufficient size to cushion a substantial portion of the player's mouth and teeth area from impacts and being of sufficient thickness to prevent any portion of the player's face from protruding from the mask piece through said visor or vision aperture and such that the mask piece is spaced a sufficient distance outwardly from the player's face to avoid interference with a layer's eyeglasses when worn.

7. A protective face guard as claimed in claim 5 wherein said visor aperture size and shape enables said visor to stabilize said mask piece when worn.

8. A protective face guard for a game using a ball or the like struck lay piece and to be worn on the head of a participating player who also wears a cap having a visor, comprising:

(a) an integrally molded mask piece formed from a lightweight sheet of molded thermoplastic material having:

(i) a front portion of generality outward curvature protective of the player's forehead, eyes, nose, mouth, chin and throat area including:

(aa) an unobstructed visor aperture positioned in an upper region of the front portion such that when the protective face guard is worn, the visor aperture resides substantially opposite the player's forehead, said visor aperture extending across substantially the full width of the front portion and being of sufficient size to conform to the shape of and to accept the insertion of a visor of a cap worn by the player and enabling said visor to stabilize said mask piece when worn; and (bb) a vision aperture positioned below the visor aperture and extending across substantially the full width of the front portion and being of sufficient size to provide the player with substantially unobstructed forward and peripheral vision; and (ii) side portions formed to provide unbroken exterior side surfaces forming continuations of the generally outward curvature of said front portion and located at respective opposite sides of and molded integral with the font portion and protective of the player's temple. cheek and lower jaw areas;

(b) pad means secured to the inside surface of said front portion of the mask piece operative to cushion the player's face from impacts; and (c) means operatively associated with said mask piece for releasably securing said mask piece to the head of the player wearing said face guard.

* * * * *

UNITED STATES PATENT AND TRADEMARK OFFICE

CERTIFICATE OF CORRECTION

PATENT NO. : 5,206,955

DATED : May 4, 1993

INVENTOR(S) : Norman O. Milligan

It is certified that error appears in the above-identified patent and that said Letters Patent is hereby corrected as shown below:

Column 3, line 50, "player" should read --player's--.

Column 6, line 68, replace "e" with --be--.

Column 7, line 15, "forehand" should read --forehead--.

Column 7, line 65, "sue" should read --use--.

Column 8, line 10, "of" should read --to--.

Column 8, line 20, "levee" should read --level--.

Column 8, line 22, "brace" should read --face--. (PTO error)

Column 8, line 63, delete "mouth" before "pad"; add --means-- after "pad".

Column 8, line 66, delete "mouth" before "pad"; add --means-- after "pad".

Column 9, line 10, after "such" add --that--.

Column 9, line 32, "lay" should read --play--.

UNITED STATES PATENT AND TRADEMARK OFFICE

CERTIFICATE OF CORRECTION

PATENT NO. : 5,206,955

DATED : May 4, 1993

INVENTOR(S) : Norman O. Milligan

It is certified that error appears in the above-indentified patent and that said Letters Patent is hereby corrected as shown below:

Column 10, line 26, "font" should read --front--

Signed and Sealed this

Eighteenth Day of January, 1994

*Attest:*

Bruce Lehman

BRUCE LEHMAN

*Attesting Officer*

*Commissioner of Patents and Trademarks*